US005494265A

United States Patent [19]

Ventre

[11] Patent Number: 5,494,265

[45] Date of Patent: Feb. 27, 1996

[54] LADLE FOR PROCESSING MOLTEN METAL WITH MINIMAL SPACE REQUIREMENTS AND IMPROVED PERFORMANCE

[75] Inventor: Isabelle Ventre, Voiron, France

[73] Assignee: Pechiney Rhenalu, Courbevoie, France

[21] Appl. No.: 442,752

[22] Filed: May 17, 1995

Related U.S. Application Data

[63] Continuation of Ser. No. 221,948, Mar. 28, 1994, abandoned.

[30] Foreign Application Priority Data

Nov. 12, 1993 [FR] France ..... 93 13808

[51] Int. Cl.[6] ..... C21C 7/00

[52] U.S. Cl. ..... 266/217; 266/242; 266/275

[58] Field of Search ..... 266/242, 217, 266/275

[56] References Cited

U.S. PATENT DOCUMENTS

| | | | |
|---|---|---|---|
| 2,408,467 | 10/1946 | Lyons | 266/242 |
| 3,724,447 | 4/1973 | Parkhill et al. | 266/242 |
| 4,021,026 | 5/1977 | Szekely | 266/275 |
| 4,705,260 | 11/1987 | Geer et al. | 266/242 |
| 4,961,563 | 10/1990 | Suarez et al. | 266/275 |

FOREIGN PATENT DOCUMENTS 0200671 11/1986 European Pat. Off. .

OTHER PUBLICATIONS

Patent Abstracts of Japan, vol. 16, No. 518, Oct. 26, 1992, JP-A-04 193 919 Jul. 14, 1992.

*Primary Examiner*—Scott Kastler
*Attorney, Agent, or Firm*—Dennison, Meserole, Pollack & Scheiner

[57] ABSTRACT

A ladle including one or more compartments for the continuous processing of molten metal, such as aluminum or its alloys, with the aid of a device for introducing gas and heating by means of a submerged immersion heater. The ladle includes a plurality of immersion heaters of small diameter having high power output per unit distributed within the ladle.

11 Claims, 1 Drawing Sheet

LADLE FOR PROCESSING MOLTEN METAL WITH MINIMAL SPACE REQUIREMENTS AND IMPROVED PERFORMANCE

This is a continuation of application Ser. No. 08/221,948, filed on Mar. 28, 1994, now abandoned.

BACKGROUND OF THE INVENTION

1. Field of the Invention

The invention relates to a ladle for processing molten metal, particularly aluminum or its alloys but also magnesium or its alloys, by gas stream, with minimal space requirements and with improved performance thermally or in other respects.

2. Description of Related Art

It is known that before undertaking the formation of semi-finished metallurgical products, it is necessary to process the raw molten metal in order to rid it of dissolved gasses and non-metallic impurities which could damage the quality of the castings.

This processing is usually done by insufflation of an appropriate gas, for example of the Ar type containing some percentage of chlorine, with the aid of a rotor immersed in the molten metal, which is itself contained in a processing ladle. Moreover, it is generally done in a continuous operation just before the casting, which is itself done continuously, the ladle also being capable of serving as a casting ladle.

In order for this processing to be the most effective, and in order for the casting to be done under suitable conditions, it is recommended that there be a high degree of homogeneity in the temperature of the molten metal, particularly during the periods of transient operation preceding or following the continuous casting; these periods are principally the period of heating the ladle before the casting, or of maintaining the temperature of the ladle between two consecutive castings.

A ladle includes one or more processing compartments, each of which contains a gas insufflation rotor which can only, in fact, process a fixed volume of molten metal; often the compartments number two. The ladle can also be equipped with a contiguous outlet compartment.

Heating of the ladles can be done with the aid of heat-producing walls and lids, but such an arrangement, while allowing for ladles with reduced space requirements, has the drawback of having inadequate thermal efficiency, of not being very effective, and of producing high temperature gradients in the molten metal. Moreover, the heat-producing lids can cause increased pollution on the surface of the molten metal through oxidation and the formation of dross. The problems of maintenance and cleaning are also severe.

It is already known that the heating can be done with the aid of a graphite block immersed in the molten metal; heating tubes are embedded in the block. Such an arrangement provides inadequately effective heating, has problems with maintenance and metal quality due to the use of graphite, and has a randomly variable lifetime, which is also associated with the use of graphite.

Heating of a processing compartment can also be done with the aid of a single immersion heater including a heating part immersed in the molten metal and a riser emerging from it which provides for the electrical connections and for its handling. Such an immersion heater is generally constituted, in its heating part, of an electrical resistance immersed in a refractory substance that is highly heat conductive and non-electrically conductive, all of which is contained in a sheath that is also highly heat conductive and that must withstand the molten metal. This sheath is advantageously made of sintered ceramic, for example sialon, which effectively withstands the molten Al or its alloys. The immersion heaters customarily used in this application have a large diameter, generally in the neighborhood of 100 to 200 mm.

Immersion heaters of this type have the advantage of providing effective heating with good thermal efficiency. Nevertheless there remain some flaws with regard to the speed of heating, the control and homogeneity of temperatures in each of the processing compartments and also in the outlet compartment, as the dimensions of the latter do not permit installation of this type of immersion heater.

Ladles equipped with rotors and with this type of immersion heater which are of large diameter can be used in various ways.

An immersion heater and a rotor can be installed simultaneously in a processing compartment; but in this case there is a reduced processing capacity and there are problems with cleaning and maintenance linked to the space required by the immersion heater and rotor that are mounted permanently in the compartment, and to the contamination of the molten metal bath.

Also, the solution which seems to offer the best existing compromise consists of temporarily installing an immersion heater requiring a great deal of space in a processing compartment during the transient periods of maintenance or heating of the molten metal, then replacing it with the gas insufflation rotor at the time of the processing and the casting. In this case, the effectiveness and the efficiency of heating by means of immersion heater is preserved without overly aggravating the heterogeneity of temperature at the time of the casting (after the replacement of the immersion heater by the rotor), and the capacity of the ladle and the cleaning and maintenance problems are improved. However, this mode of operation necessitates the use of a handling gantry which noticeably increases the floor space taken up by the installation; an application of this type is illustrated for example in the French patent FR 2514370; moreover the performance of this mode of operation is limited relative to the type of immersion heater used, as has been seen above.

SUMMARY OF THE INVENTION

Applicant has sought to solve the problems of homogeneity and control of the temperature of the ladle, which are due to the use of the type of immersion heater described previously, and the problems with the operation and the bulk of the ladle, which are also linked to the use of this type of immersion heater.

Applicant has therefore researched a processing ladle which not only permits the preservation of efficiency and effectiveness due to the use of immersion heaters, but has also tried to improve the thermal homogeneity of the molten metal during the transient states and the casting, while improving the processing capacity and the efficiency of the ladles, diminishing their space requirements and considerably reducing the problems with cleaning and maintenance and with its operation in general.

DETAILED DESCRIPTION OF THE INVENTION

The invention is a ladle including one or more compartments for the continuous processing of molten metal with the aid of a device for introducing gas for processing and for heating by immersion heater submerged in the molten metal, characterized in that it includes a plurality of immersion heaters of small diameter and high power output per unit distributed within the ladle.

The ladle is particularly adaptable to the processing of aluminum or its alloys, but also of magnesium or its alloys.

The immersion heaters and the device for introducing gas are generally simultaneously mounted in the ladle during operation, thus avoiding their having to be handled with each new casting.

A simple device, however, can allow the assembly of immersion heaters, even the rotors, to be lifted, in order to completely clear the surface of the bath with a view toward periodic cleaning.

The processing is generally done in rotation on the raw molten metal circulating continuously in the ladle, which originates from a smelting plant, the processed metal then exiting the ladle to be directly cast into different forms: plates, billets, strips, molded castings, etc.

The device of the invention is particularly advantantageous for assuring temperature maintenance or heating of the ladle for continuous processing; it is also well adapted for batch processing.

The ladle is generally of high capacity, containing several tons of molten metal, and it may include one or preferably more processing compartments in the strict sense of the term, each of which is equipped with a device for introducing gas, for example immersed rotors and a plurality of immersion heaters (generally two or more). It may also include an outlet compartment which permits casting only of clean metal that is not polluted by potential dross resulting from the processing or from a superficial oxidation of the molten metal at the time of the processing. But the invention applies more generally to all types of ladles, including those of small dimensions or test ladles, with the same advantages.

Like those known in the prior art, the immersion heaters used in the invention include a heating part immersed in the molten metal topped with a non-heating, non-immersed extension piece which allows electrical connections and handling; their heating part is covered with a sheath, advantageously of sintered ceramic, for example aluminum, zircon, Alon, sialon, mixed oxynitride (of the MgAlON type), nitride, boride, etc., which effectively withstands the molten aluminum and has an excellent thermal conductivity compared to those in the prior art; on the other hand, they have minimal space requirements for an equivalent power output.

The advantages linked to the use of the ladle according to the invention are above all obtained with immersion heaters whose heating part has a diameter of less than 100 mm, preferably less than 40 mm, or even better less than 30 mm.

Moreover, given the small diameter of the immersion heaters, among other factors, the ladle has an unexpected cabability to disperse an energy greater than 5 kW per meter of immersed heating part, even greater than 10 kW/m, or even 20 kW/m, without spoiling the molten metal with excessive temperatures and without the difference in temperature between the molten metal and the immersion heater exceeding tens of ° C.

It is advantageous that the heating part affects the entire depth of the bath of molten metal.

The immersion heaters can be installed in proximity to the walls of the ladle without harming the homogeneity of the temperature of the molten metal, including during the transient periods. Rearranging the immersion heaters of a ladle along the same wall eases the problems of maintenance and cleaning.

It is also very advantageous for the outlet compartment to be equipped with at least one immersion heater of this type, the temperature of the metal found there thus being able to be brought precisely to the desired value. This significantly improves the thermal quality of the molten metal, particularly at the time of the transient periods of maintenance or heating, and makes it possible to avoid drawbacks and the risks of solidification at the beginning of casting.

The immersion heaters are permanently installed in the ladles during the periods of operation; however, they can be fastened to a simple hoisting device, preferably motorized and permanently installed in the ladle, in such a way that they can be withdrawn or manipulated easily in order to carry out the operations of maintenance of the ladle, and skimming and cleaning of the surface of the bath.

It is also advantageous to mount the immersion heaters jointly on a single frame or on a hatch for access to the bath, activated by the hoisting system, in such a way that they can be manipulated together and that the aforementioned operations are again facilitated.

Improvements can also be brought about by using this hoisting device to simultaneously lift the rotor and the immersion heaters, or by installing this rotor on the same frame or hatch as the immersion heaters.

DESCRIPTION OF THE PREFERRED EMBODIMENT

Figure 1:
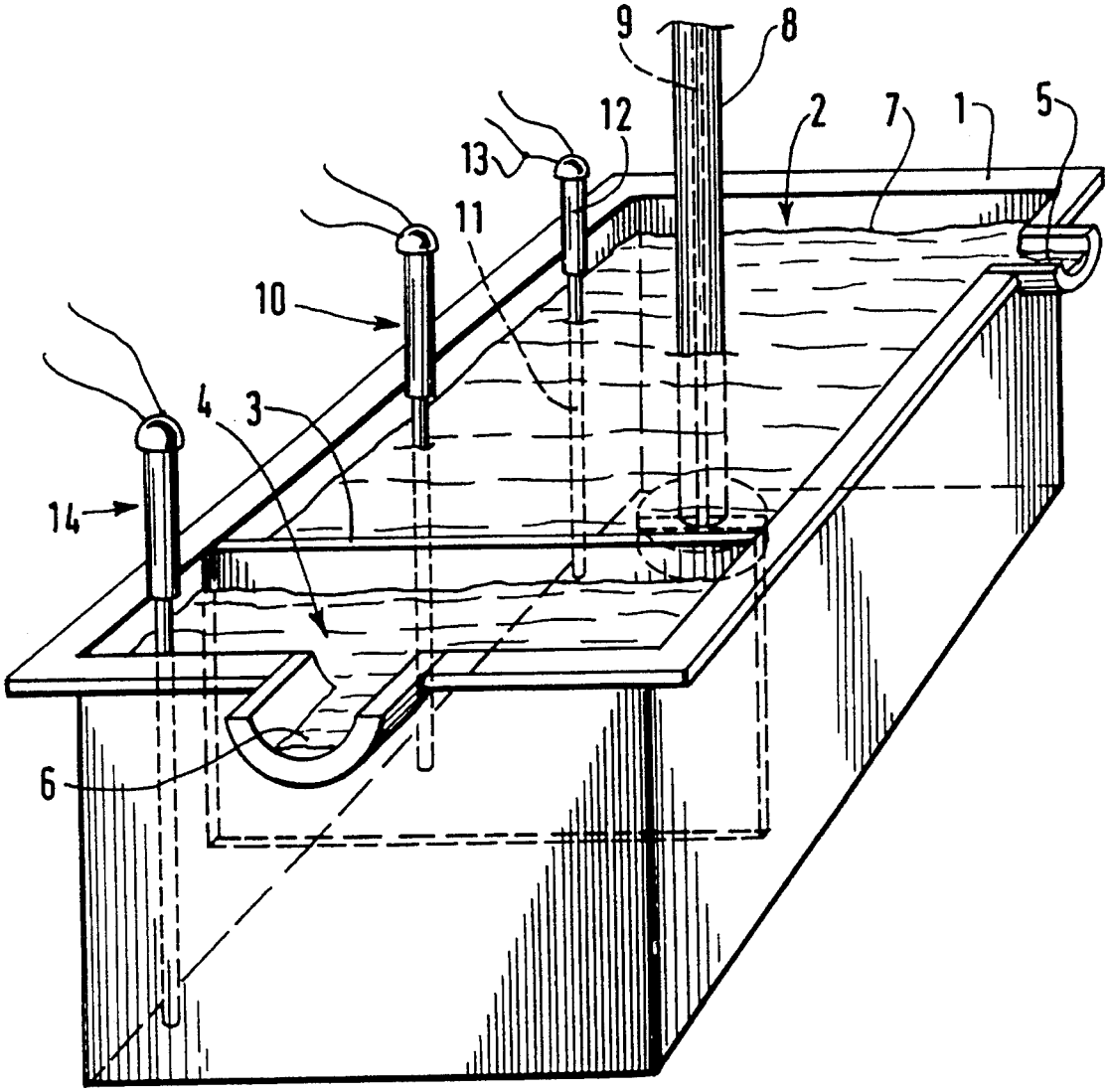
FIG. 1 is a perspective view of a ladle according to the invention including a single processing compartment and an outlet compartment.

FIG. 1 shows the enclosure (1) of the ladle, including a single processing compartment (2) separated by a partition (3) from the outlet compartment (4) which is connected at the bottom to the processing compartment (2). The enclosure (1) may be constituted by an external metallic envelope and an interior refractory lining (not represented). The ladle is supplied at (5) with the raw metal to be processed, while the processed metal emerges at (6) to be cast. The molten metal, whose level is represented by (7), is processed with the aid of a rotor device (8) including a duct (9) for feeding gas into the molten metal (7). It is heated by a battery of immersion heaters (10) with their heating part (11) immersed and their riser (12) providing, among other things, their electrical connection (13). An immersion heater (14) is likewise installed in the outlet compartment (4).

In the case of the figure, it can be seen that the immersion heaters (10, 14) are installed in proximity to the same wall of the ladle. But it is quite evident that they could be disposed differently if the need were to make itself felt.

The ladle can advantageously include two (or more) processing compartments of the type (2), with a view to processing a greater quantity of metal. They usually function in series, or in any other arrangement compatible with the constraints of operation, opening into the outlet compartment. Each of the compartments typically includes a gas introducing device (rotor for example) and two immersion heaters which suffice in general to assure control of the temperature while avoiding an exaggerated obstruction of the interior space of the ladle.

By way of illustrating the invention, a ladle with a capacity of 4 t of aluminum, or its alloys, and including two processing compartments and one outlet compartment in series, has been equipped with a rotor and two immersion heaters per processing compartment and one immersion heater in the outlet compartment. The immersion heaters are all identical, have a power output per unit of 10 kW, a length of 1 m and an exterior diameter of the heating part of 28 mm. In such a ladle, the maximum temperature differences do not exceed 5° C., and the temperature of the outlet compartment differs not more than 5° C. from the casting temperature; moreover the time separating two castings does not exceed 1 hour.

By comparison, in an analogous ladle with two compartments, where in accordance with the prior art, an immersion heater of large diameter and a rotor are introduced alternately into each compartment, the maximum temperature differences are about 40° C., without the possibility of precisely regulating the temperature of the outlet compartment, and the time between two castings, including the time of the rotor-immersion heater changeover, is at least 2 hours. Moreover, such a ladle with its specific handling equipment occupies a floor space of about 30% more than that occupied by the ladle according to the invention.

Thus, the ladle according to the invention has the following advantages:

It occupies a minimum amount of floor space; this reduced space requirement is due in particular to the absence of specific handling equipment, which the prior art requires, for effecting the rotor-immersion heater substitution regularly, and during operation; the gain in space is on the order of 30%;

the heating time is significantly reduced, not only in relation to the ladles heated by the exterior walls or by the partition between the two compartments, but also in relation to the ladles using only one immersion heater;

the homogeneity and control of the temperature in the processing compartments and in the outlet compartment are improved, during the periods of raising, as well as maintaining, the temperature; this permits perfect control of the temperature of the cast metal while avoiding losses of metal at the beginning of casting by reason of nonconformity and increasing the quality of the castings obtained.

Thus it is noted that the maximum temperature differences do not exceed 5° C. so that it is not necessary to superheat the ladle of metal (which appreciably limits the appearance of dross) and so that the risks of solidification during casting are more or less eliminated.

The operations of maintenance and cleaning of the ladle are facilitated; removal of the immersion heaters is not always necessary or is much simplified owing to easy and rapid handling of the immersion heaters, making it possible to avoid stoppages in production.

The capacity of the installation is increased as a function of the simplification of the factory operations and of the speed of heating and homogenizing of temperatures due to the number of immersion heaters in each processing compartment.

I claim:

1. An apparatus for the continuous processing of molten metal, comprising:

a) a apparatus having at least one compartment for containing molten metal;

b) means for introducing gas into said at least one compartment, extending below the surface of molten metal contained therein; and c) a plurality of electrical immersion heaters of diameter less than 100 mm and high power output per unit distributed within said at least one compartment such that a portion of each said heater is below the surface of molten metal contained within the compartment, and a portion of each of said heaters extends above the surface of molten metal for connection to a source of electric current.

2. The apparatus according to claim 1, wherein the apparatus contains a molten metal selected from the group consisting of aluminum, aluminum alloys, magnesium and magnesium alloys.

3. The apparatus according to claim 1, wherein the power output of the immersion heaters is at least 10 kW per meter of heating length immersed.

4. The apparatus according to claim 1, wherein the immersion heaters are equipped with sintered ceramic sheaths, highly heat conductive and quite able to withstand the molten metal.

5. The apparatus according to claim 1, wherein said ladle includes an outlet compartment containing an immersion heater.

6. The apparatus according to claim 1, wherein the immersion heaters are mounted on a hoisting system.

7. The apparatus according to claim 6, wherein the hoisting system includes a hatch for access to the bath to which the immersion heaters are fastened.

8. The apparatus according to claim 6, wherein the hoisting system includes the means for introducing gas.

9. The apparatus according to claim 7, wherein the hoisting system includes the means for introducing gas.

10. The apparatus according to claim 1, wherein the diameter of the immersion heaters is less than 40 mm.

11. The apparatus according to claim 1, wherein the apparatus comprises two compartments for containing molten metal, arranged in series.

* * * * *